US008197023B2

(12) United States Patent
Iwase et al.

(10) Patent No.: US 8,197,023 B2
(45) **Date of Patent: *Jun. 12, 2012**

(54) LIQUID JET RECORDING APPARATUS AND LIQUID JET RECORDING METHOD

(75) Inventors: Fumiyoshi Iwase, Shizuoka-ken (JP); Tetsuya Murase, Chiba (JP); Masatoshi Toda, Chiba (JP)

(73) Assignee: SII Printek Inc. (JP)

( * ) Notice: Subject to any disclaimer, the term of this patent is extended or adjusted under 35 U.S.C. 154(b) by 357 days.

This patent is subject to a terminal disclaimer.

(21) Appl. No.: 12/583,958

(22) Filed: Aug. 28, 2009

(65) Prior Publication Data

US 2010/0053253 A1 Mar. 4, 2010

(30) Foreign Application Priority Data

Aug. 29, 2008 (JP) ..... 2008-221651

(51) Int. Cl.
*B41J 29/38* (2006.01)

(52) U.S. Cl. ..... 347/17

(58) Field of Classification Search ..... 347/5, 9, 347/17, 84, 85
See application file for complete search history.

(56) References Cited

U.S. PATENT DOCUMENTS 7,407,241 B2 * 8/2008 Mutoh et al. ..... 347/5
7,517,032 B2 * 4/2009 Nottelman et al. ..... 347/5

* cited by examiner

*Primary Examiner* — An Do
(74) *Attorney, Agent, or Firm* — Adams & Wilks

(57) ABSTRACT

A liquid jet recording apparatus includes a liquid container that contains liquid, a jetting portion disposed at a lower level than the surface of the liquid contained in the liquid container for jetting the liquid, and a conduit for communicating the jetting portion with the liquid container. An on-off valve opens or closes the conduit to permit or block the flow of the liquid in the conduit. A liquid storing portion damps pressure fluctuations of the liquid which flows in the conduit and is disposed in the conduit between the on-off valve and the jetting portion. A pressure sensor measures the pressure of the liquid in the conduit, and a control portion controls the on-off valve to be opened or closed based on a pressure value measured by the pressure sensor.

17 Claims, 4 Drawing Sheets

LIQUID JET RECORDING APPARATUS AND LIQUID JET RECORDING METHOD

BACKGROUND OF THE INVENTION

1. Field of the Invention

The present invention relates to a liquid jet recording apparatus and a liquid jet recording method.

2. Description of the Related Art

Conventionally, as an apparatus for jetting liquid toward a recording medium, a liquid jet recording apparatus for jetting a droplet from a plurality of nozzles toward a recording medium is known. As such a liquid jet recording apparatus, for example, one having a liquid jet head mounted thereon for jetting toward a recording medium a droplet of several to several ten picoliters is known. A liquid jet head which jets such a minute droplet is adapted to control liquid in the nozzle so as to be optimum for being jetted in order to materialize satisfactory jetting of the liquid. Here, a state of liquid which is optimum for being jetted is a state in which the pressure of the liquid in the nozzle is a negative pressure and a meniscus is formed in the nozzle. In order to make such a pressure adjustment, an apparatus is known in which a pump or an air valve is provided in a flow path of liquid between a liquid container and a liquid jet head for adjusting the pressure.

Japanese Patent Application Laid-open No. 2005-34999 describes an ink jet printer including a pump for depressurizing liquid in a nozzle of a liquid jet head, an air communication valve for pressurizing liquid in the nozzle of the liquid jet head, a pressure sensor for measuring the pressure of liquid in the nozzle of the liquid jet head, and a control portion for operating the pump and the air communication valve based on a measured value by the pressure sensor. In the ink jet printer (liquid jet recording apparatus), the pressure of liquid to be supplied to the nozzle is adapted to be increased or decreased by the pump and the air communication valve disposed in a liquid flow path from an auxiliary tank (liquid container) for storing liquid to the liquid jet head.

However, the ink jet printer described in Japanese Patent Application Laid-open No. 2005-34999 has a problem that, both the pump and the air communication valve are necessary for increasing and decreasing the pressure of the liquid in the nozzle, and hence the structure of the apparatus is complicated.

Further, as an ink jet printer in recent years, a large printing apparatus which can print a large area of a surface of a poster or a signboard is often used, and there is a tendency to enlarge the apparatus in a specific field. In such a large printing apparatus, compared with a case of a small printing apparatus, the distance from a liquid container for storing liquid to be jetted to a liquid jet head is larger, and thus, the length of a flow path for supplying the liquid to the liquid jet head is larger. Therefore, in a large apparatus, the loss of pressure on the liquid in the flow path increases, and the liquid may be prevented from being supplied to the liquid jet head with the pressure thereon being held appropriate for the liquid jet environment. In order to precisely set the pressure value of liquid in the liquid jet head, it is necessary to precisely measure the pressure value in the liquid jet head and to supply the liquid with appropriate pressure thereon being held.

Further, when a carriage including a liquid jet head scans a range to be printed, the position of a flow path for communicating a liquid container with the liquid jet head repeatedly changes as the carriage moves, and hence liquid existing in the flow path is under a pressure load. In this case, liquid affected by the pressure load is supplied to the liquid jet head which is located downstream from the flow path, and thus, it is difficult to hold the appropriate pressure for the liquid jet environment. Normally, such a pressure load on liquid is reduced by a pressure damper (liquid storing portion), however, pressure loss due to the increased length of the flow path still affects the liquid, which prevents materialization of an appropriate printing environment.

Further, as the range to be printed increases as described above, the range to be scanned by the carriage including the liquid jet head also increases, and thus, liquid having the amount beyond the ability of the pressure damper to decrease the pressure load may be supplied to the liquid jet head, and thus, deterioration of the printing environment is expected as the apparatus becomes larger.

As described above, in order to prepare a sophisticated printing environment for a printing apparatus, there is an urgent necessity to precisely measure and grasp the pressure of liquid in the liquid jet head.

SUMMARY OF THE INVENTION

The present invention has been made in view of the above-mentioned circumstances, and it is an object of the invention to provide a liquid jet recording apparatus and a liquid jet recording method, which are capable of attaining a simple apparatus structure.

In order to attain the object described above, the present invention provides a liquid jet recording apparatus and a liquid jet recording method described below.

The liquid jet recording apparatus according to the present invention includes: a liquid container for containing liquid; a jetting portion which is disposed lower than a surface of the liquid contained in the liquid container and includes a plurality of nozzles for jetting the liquid; a conduit for communicating the jetting portion with the liquid container to make the liquid flow, the conduit being disposed between the jetting portion and the liquid container; an on-off valve which is disposed in the conduit and fixed to a frame; a liquid storing portion for damping pressure fluctuations of the liquid which flows in from one end of the conduit, the liquid storing portion being disposed in the conduit between the on-off valve and the jetting portion; a pressure measuring unit for measuring the pressure of the liquid which flows through the conduit, the pressure measuring unit being disposed in the conduit between the liquid storing portion and the jetting portion; and a control portion for controlling the on-off valve to be opened and closed based on a pressure value measured by the pressure measuring unit, the control portion being electrically connected to the pressure measuring unit and the on-off valve.

According to the present invention, the pressure measuring unit measures the pressure of the liquid after pressure fluctuations are damped by the liquid storing portion, and sends the pressure value to the control portion. The control portion operates the on-off valve and controls the conduit to be opened or closed to control the flow of the liquid. When the inside of the conduit is made to communicate by the on-off valve, the liquid in the liquid container flows through the conduit by gravity via the liquid storing portion and via a branch tube to be supplied to the jetting portion. On the other hand, when the inside of the conduit is blocked by the on-off valve, the flow of the liquid from the liquid container to the liquid storing portion is interrupted. As the liquid is jetted from the jetting portion, the amount of the liquid from the on-off valve to the jetting portion decreases to reduce the pressure of the liquid. As a result, the pressure of the liquid in the branch tube is held most appropriate. Further, because the on-off valve is disposed closer to the side of the liquid container than the liquid storing portion, pressure fluctuations due to the operation of the on-off valve is damped by the liquid storing portion, and thus, pressure fluctuations in the jetting portion are reduced.

In the liquid jet recording apparatus according to the present invention, the pressure measuring unit is directly disposed in the conduit which connects the liquid storing portion and the jetting portion.

According to the present invention, because the length of the flow path of the liquid from the jetting portion to the pressure measuring unit is decreased, a time lag from when pressure fluctuations of the liquid are caused in the jetting portion to when the pressure fluctuations of the liquid are measured by the pressure measuring unit is reduced and the pressure of the liquid in the jetting portion is precisely measured, and the space occupied by the mounted pressure measuring unit can be made smaller.

In the liquid jet recording apparatus according to the present invention, the pressure measuring unit is connected to a pressure transmitting conduit which is branched from the conduit connecting the liquid storing portion and the jetting portion.

According to the present invention, it is merely required that the conduit connecting the liquid storing portion and the jetting portion have a length capable of connecting the pressure transmitting conduit. The liquid storing portion and the jetting portion can be disposed so as to be adjacent to each other, which provides a higher degree of flexibility in disposing the pressure measuring unit.

In the liquid jet recording apparatus according to the present invention, the pressure transmitting conduit includes a flexible tube which is impervious to gas.

According to the present invention, increased viscosity or hardening of the liquid due to entry of gas into the pressure transmitting conduit and increased viscosity or hardening of the liquid due to vaporization of a volatile solvent included in the liquid and leakage of the volatile solvent from within the pressure transmitting conduit to the outside are suppressed. Therefore, narrowing of the pressure transmitting conduit due to the liquid is suppressed. Further, lowering of the measurement precision by the pressure measuring unit due to attachment of the liquid with increased viscosity or the hardened liquid to the pressure measuring unit is suppressed.

In the liquid jet recording apparatus according to the present invention, the pressure transmitting conduit is made of a metallic material.

According to the present invention, by using the metallic material, influence of cracks due to aging and the like is reduced compared with a case in which a tubular member made of a resin is used, entry of a fluid, light, or the like via the wall of the pressure transmitting conduit into the pressure transmitting conduit is suppressed, and deterioration of the liquid such as increased viscosity or hardening is suppressed.

In the liquid jet recording apparatus according to the present invention, the pressure transmitting conduit is made of a flexible member which suppresses permeability to light having a specific wavelength.

According to the present invention, because permeability to light having the specific wavelength via the wall of the pressure transmitting conduit is suppressed, increased viscosity or hardening of liquid which is cured with the light having the specific wavelength in the pressure transmitting conduit is suppressed.

In the liquid jet recording apparatus according to the present invention, the pressure transmitting conduit is detachable from the conduit.

According to the present invention, by detaching the pressure transmitting conduit from the conduit, the inside of the pressure transmitting conduit can be cleaned and the pressure transmitting conduit and the pressure measuring unit can be replaced.

The liquid jet recording apparatus according to the present invention further includes a carriage which supports the jetting portion and is capable of reciprocating above a recording medium toward which the liquid is jetted, the jetting portion being supported so as to be at a predetermined distance from the recording medium, and the liquid storing portion is fixed to and supported by the carriage.

According to the present invention, with regard to a liquid jet head without the branch tube for connecting the pressure measuring unit, the pressure of the liquid which is damped by the liquid storing portion disposed on the carriage is also measured.

In the liquid jet recording apparatus according to the present invention, the conduit provided between the pressure measuring unit and the jetting portion has a length in a range of 50 mm to 600 mm.

According to the present invention, when the length of the conduit from the pressure measuring unit to the jetting portion is less than 50 mm, disposition of the pressure measuring unit is low in flexibility and it is difficult to dispose the liquid storing portion on the carriage so as to be apart from the jetting portion, whereas, because the length of the conduit from the pressure measuring unit to the jetting portion is longer than 50 mm, it is possible to dispose the liquid storing portion on the carriage so as to be apart from the jetting portion.

If the length of the conduit from the pressure measuring unit to the jetting portion is more than 600 mm, because the amount of pressure fluctuations of the liquid which is absorbed by the conduit is large, the pressure value measured by the pressure measuring unit deviates from the pressure fluctuations in the jetting portion, and thus, it is difficult to measure the pressure precisely, whereas, because the length of the conduit from the pressure measuring unit to the jetting portion is less than 600 mm, effect of the pressure fluctuations on the precision of jetting the liquid is small. Therefore, the pressure of the liquid is measured by the pressure measuring unit with sufficient precision for the liquid jet head to appropriately jet the liquid.

In the liquid jet recording apparatus according to the present invention, the pressure measuring unit is disposed +10 mm to +300 mm above a level of the nozzles of the jetting portion.

According to the present invention, when the pressure measuring unit is disposed less than +10 mm above the level of the nozzles of the jetting portion, the pressure measuring unit limits the position at which the jetting portion is disposed, whereas, because the pressure measuring unit is disposed more than +10 mm above the level of the nozzles of the jetting portion, the jetting portion and the pressure measuring unit do not interfere with each other.

Further, when the pressure measuring unit is disposed more than +300 mm above the level of the nozzles of the jetting portion, the pressure value measured by the pressure measuring unit deviates by a large amount from the pressure value in the jetting portion, and thus, it is difficult to measure the pressure precisely, whereas, because the pressure measuring unit is disposed less than +300 mm above the level of the nozzles of the jetting portion, the difference between the pressure of the liquid measured by the pressure measuring unit and the pressure of the liquid in the jetting portion can be made smaller. As a result, the precision falls within a range required to adjust the pressure of the liquid.

In the liquid jet recording apparatus according to the present invention, the liquid storing portion includes a liquid storing chamber formed of a flexible thin-film-like member and the flexible thin-film-like member suppresses entry or leakage of gas from outside of the liquid storing portion via the flexible thin-film-like member.

According to the present invention, the liquid storing portion absorbs with the thin-film-like member pressure fluctuations propagating from the conduit. Further, the thin-film-like member suppresses increased viscosity or hardening of the liquid due to the entry of gas and mixing of air bubbles into the liquid jetted from the jetting portion.

In the liquid jet recording apparatus according to the present invention, the pressure value of the liquid supplied to the jetting portion is in a range of 20 kPa to 60 kPa.

According to the present invention, when the water pressure is 20 kPa or less, it is difficult to apply sufficient pressure to send the liquid to all the nozzles, and, when the water pressure is 60 kPa or more, appropriate control is difficult because the inflow rate of the liquid supplied to the jetting portion is too high, whereas, when the water pressure is adjusted to be in the range of 20 kPa to 60 kPa, the liquid can be satisfactorily charged from the liquid container into the jetting portion by opening or closing the on-off valve, while allowing fluctuations in the amount of the liquid remaining in the liquid container.

The liquid jet recording method according to the present invention includes: monitoring a pressure value indicated by the pressure measuring unit and measuring a pressure of the liquid; determining whether the pressure of the liquid is between an upper limit pressure and a lower limit pressure which are set in advance; and blocking the conduit by the on-off valve when the pressure of the liquid is between the upper limit pressure and the lower limit pressure, making the conduit communicate by the on-off valve when the pressure of the liquid is lower than the lower limit pressure, and making the liquid jetted from the jetting portion to be discharged when the pressure of the liquid is higher than the upper limit pressure.

According to the present invention, first, the pressure measuring unit measures the pressure of the liquid on the side of the jetting portion from the liquid storing portion. Then, the control portion determines whether the pressure value of the liquid is between the upper limit pressure value and the lower limit pressure value. Here, when the pressure value is between the upper limit pressure value and the lower limit pressure value, if the inside of the conduit is made to communicate by the on-off valve, the control portion operates the on-off valve to block the conduit. When the pressure value of the liquid is lower than the lower limit pressure value, the control portion operates the on-off valve to make the inside of the conduit communicate. When the pressure value of the liquid is higher than the upper limit pressure value, if the inside of the conduit is made to communicate by the on-off valve, the control portion operates the on-off valve to block the conduit and makes the liquid discharged from the jetting portion to decrease the pressure of the liquid supplied to the jetting portion. As a result, the pressure of the liquid in the jetting portion is appropriately adjusted and the liquid is jetted from the jetting portion with high precision.

The liquid jet recording method according to the present invention further includes exerting correction control by the control portion with regard to the difference between the pressure value in the nozzles and the pressure value measured by the pressure measuring unit.

According to the present invention, in the exerting the correction control, the pressure value of the liquid measured by the pressure measuring unit is corrected to obtain the pressure of the liquid in the nozzles and outputting the corrected pressure value, to thereby adjust the pressure value in the nozzles based on the pressure value measured by the pressure measuring unit.

In the liquid jet recording method according to the present invention, the upper limit pressure value and the lower limit pressure value are set with regard to the pressure value of the liquid in the nozzle.

According to the present invention, the pressure value of the liquid in the nozzles is controlled to be between the upper limit pressure value and the lower limit pressure value, and hence the pressure of the liquid is adjusted such that the liquid is satisfactorily jetted from the nozzles regardless of the location at which the pressure measuring unit measures the pressure of the liquid.

In the liquid jet recording method according to the present invention, the upper limit pressure value is +0.5 kPa and the lower limit pressure value is −2.0 kPa.

According to the present invention, when the upper limit pressure value is +0.5 kPa or more, the liquid leaks from the nozzle of the jetting portion, and hence it is difficult to jet the liquid as a droplet. On the other hand, when the lower limit pressure value is −2.0 kPa or less, the liquid is not sufficiently supplied to the nozzle of the jetting portion. By controlling the pressure of the liquid to be in a range of +0.5 kPa to −2.0 kPa, a meniscus surface by the liquid is formed in the nozzle of the jetting portion, and the liquid can be jetted by the jetting portion as a droplet toward the recording medium. Further, by controlling the pressure of the liquid to have a range of +0.5 kPa to −2.0 kPa, excessive open/close operations of the on-off valve made by frequently reversing the control from increasing the pressure to decreasing the pressure and vice versa by the control portion are suppressed.

In the liquid jet recording method according to the present invention, the upper limit pressure value is −0.5 kPa and the lower limit pressure value is −1.0 kPa.

According to the present invention, because both of the upper limit pressure value and the lower limit pressure value are negative pressures, and, in particular, the pressure of the liquid is adjusted to be in the range of −0.5 kPa to −1.0 kPa, a meniscus surface by the liquid is satisfactorily formed in the nozzles and the liquid can be satisfactorily jetted as a droplet.

According to the liquid jet recording apparatus and the liquid jet recording method of the present invention, the pressure of the liquid supplied from the liquid container to the jetting portion is adjusted only by open/close operation of the on-off valve, to thereby simplify the apparatus structure.

DETAILED DESCRIPTION OF THE PREFERRED EMBODIMENTS (First Embodiment)

Figure 1:
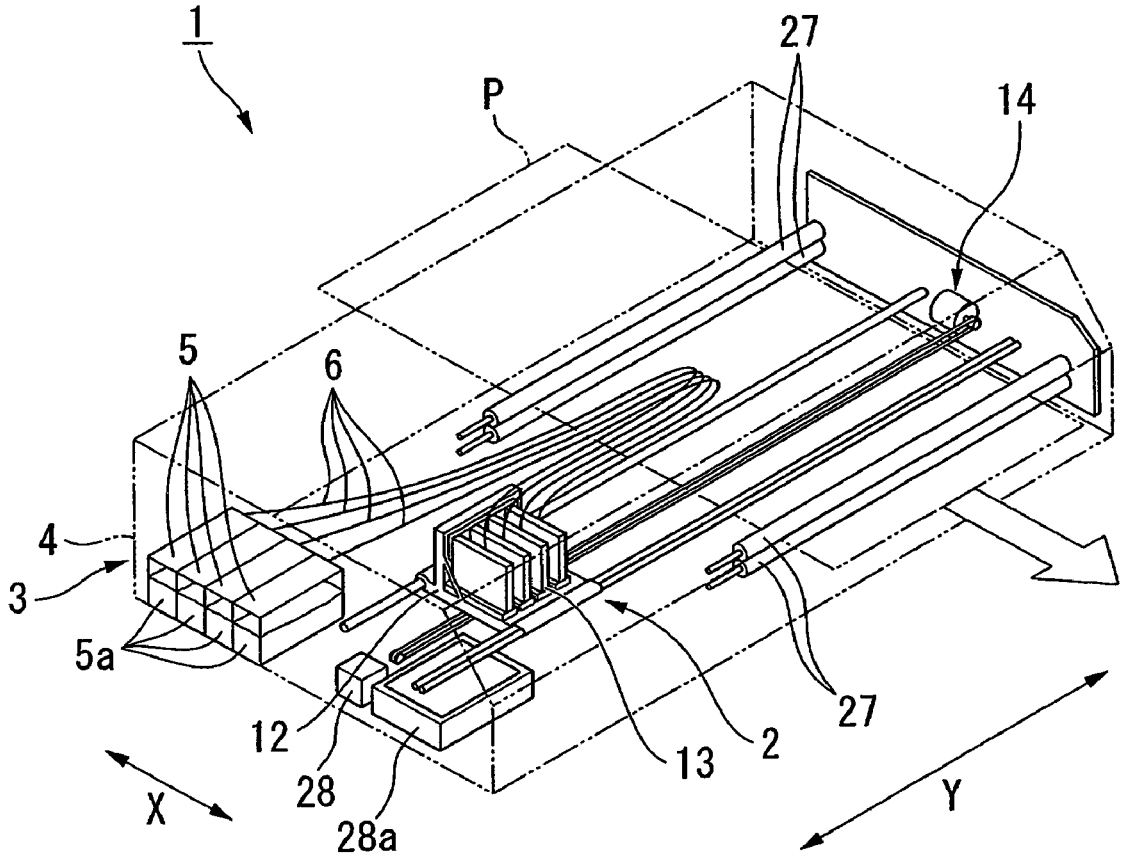
FIG. 1 illustrates a structure of a liquid jet recording apparatus according to the present invention.
Figure 2:
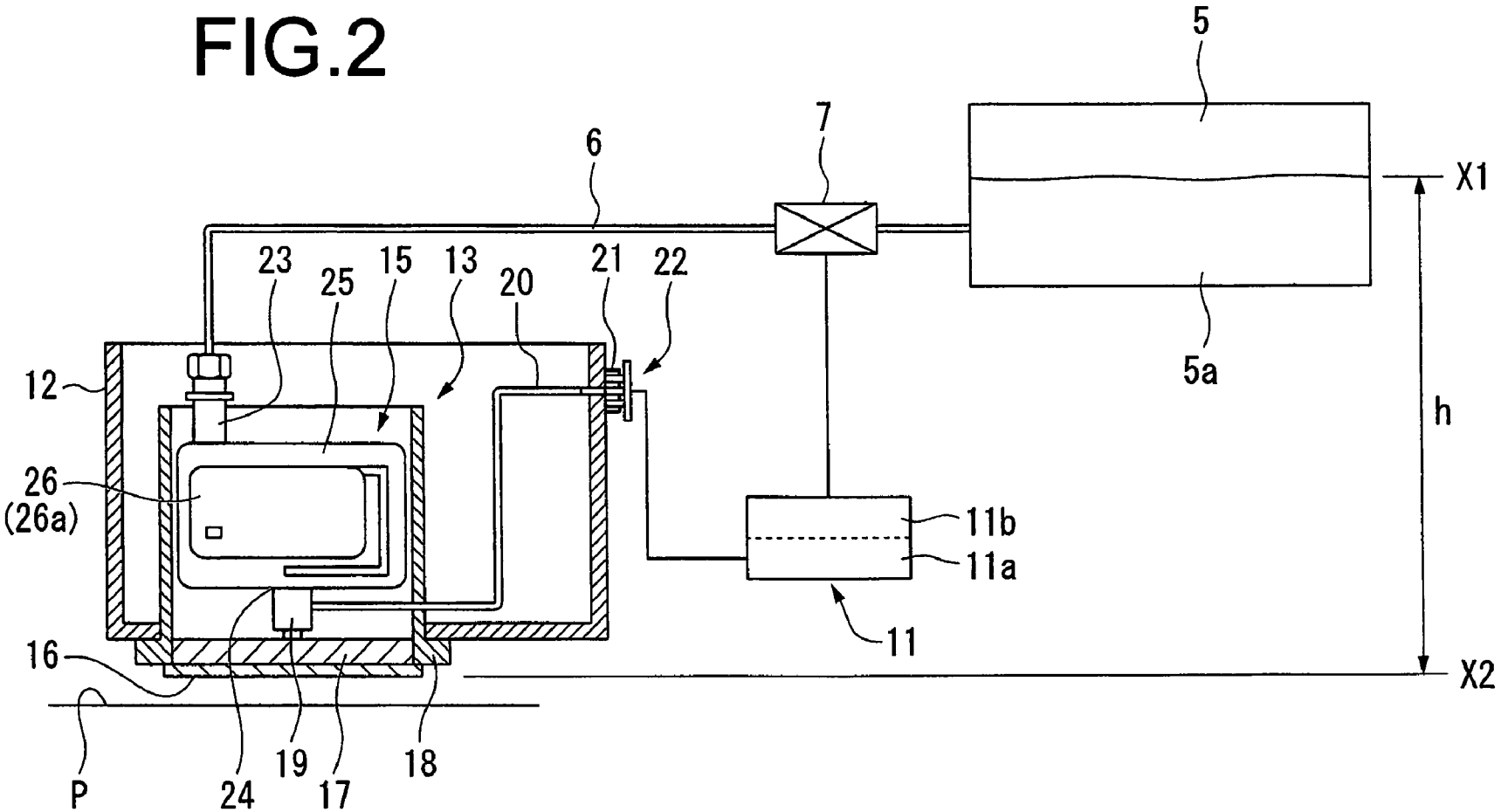
FIG. 2 is an explanatory view of a structure of a flow path of liquid from a liquid container to a jetting portion according to a first embodiment of the present invention.
Figure 3:
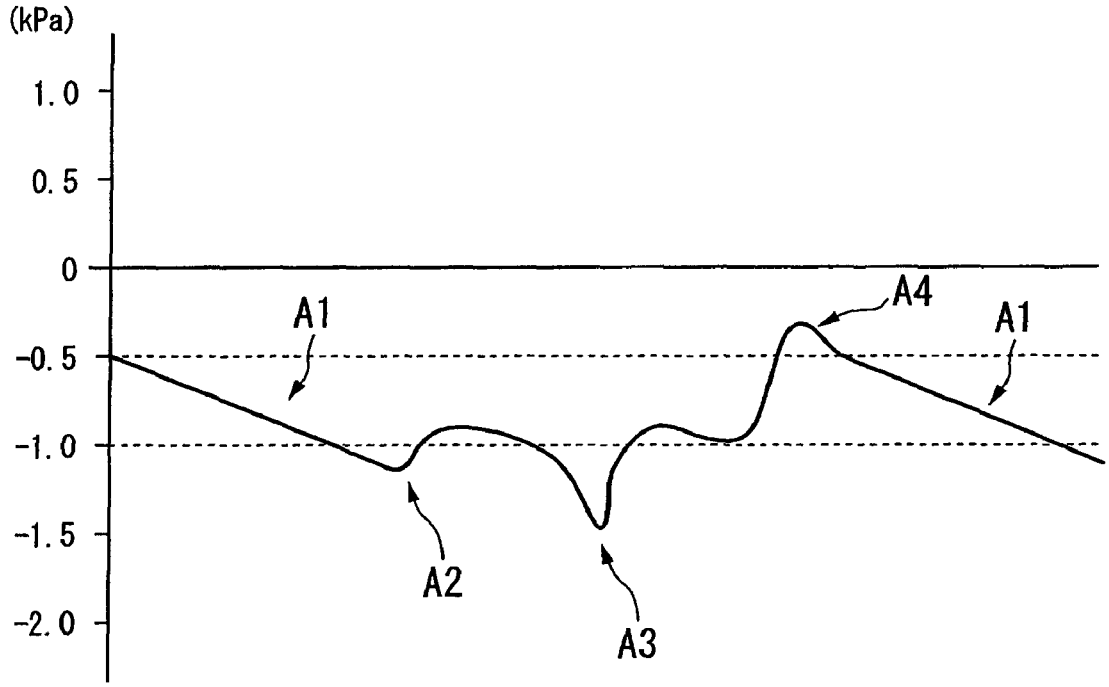
FIG. 3 is an explanatory view of operation of liquid pressure control according to the first embodiment of the present invention.

A liquid jet recording apparatus according to a first embodiment of the present invention is now described in the following with reference to FIGS. 1 to 3. FIG. 1 is an explanatory view for describing a structure of the liquid jet recording apparatus according to this embodiment. Further, FIG. 2 is an explanatory view for describing a structure of a flow path of liquid from a liquid container to a jetting portion. FIG. 3 is an explanatory view of operation of liquid pressure control according to the present invention.

As illustrated in FIGS. 1 and 2, a liquid jet recording apparatus 1 includes in a frame 4, a liquid jet mechanism 2 for jetting liquid 5*a* toward a recording medium P such as a paper sheet, a liquid supply mechanism 3 for supplying the liquid 5*a* to the liquid jet mechanism 2, a transfer mechanism 27 for transferring the recording medium P in directions indicated by arrows X in FIG. 1 below the liquid jet mechanism 2, and a control portion 11 electrically connected to the respective mechanisms described above. The liquid supply mechanism 3 includes a liquid container 5 for storing the liquid 5*a*, a flexible tubular conduit 6 having one end connected to a part of the liquid container 5, and an on-off valve 7 engaged with a middle portion of the conduit 6 and electrically connected to the control portion 11 for blocking or unblocking the inside of the conduit 6 to prevent or permit flow of the liquid 5*a* through the conduit 6. Further, the on-off valve 7 is fixed to the frame 4.

The liquid jet mechanism 2 includes a carriage 12 which is movably disposed above the recording medium P and a liquid jet head 13 fixed to the carriage 12 for jetting the liquid 5*a* toward the recording medium P side. The carriage 12 is held by a moving mechanism 14 for reciprocating the carriage 12 in directions indicated by arrows Y in FIG. 1 above the recording medium P.

The liquid jet head 13 includes a liquid storing portion unit 15 having one end connected to the other end of the conduit 6 for damping pressure fluctuations of the liquid 5*a*, a jetting portion 17 with a nozzle surface 16 having a plurality of nozzles for jetting the liquid 5*a* in minute droplets disposed therein, a first support portion 18 for fixing the liquid storing portion unit 15 and the jetting portion 17 so as to be adjacent to each other, a branch portion 19 formed in a part between the liquid storing portion unit 15 and the jetting portion 17, a pressure transmitting conduit 20 made of a flexible tubular member having one end connected to the branch portion 19, and a pressure sensor 22 connected to the other end of the pressure transmitting conduit 20 and fixed to the carriage 12.

The jetting portion 17 is disposed such that the nozzle surface 16 is lower than the liquid container 5. The liquid 5*a* is supplied to the jetting portion 17 utilizing a head difference h between a level X1 of the liquid 5*a* in the liquid container 5 and a level X2 of the liquid 5*a* in the jetting portion 17. Further, in this embodiment, the levels X1 and X2 and the head difference h are adjusted so that a pressure value of the liquid 5*a* supplied to the jetting portion 17 is 20 kPa to 60 kPa as measured in the jetting portion 17.

The pressure transmitting conduit 20 is made of a material which suppresses permeability to gas. Further, the pressure sensor 22 is electrically connected to the control portion 11. The liquid storing portion unit 15 includes a liquid storing portion case 25 having communicating portions 23 and 24 connected to the conduit 6 and the branch portion 19, respectively, and a substantially bag-like liquid storing portion 26 housed in the liquid storing portion case 25 and connected to the communicating portions 23 and 24.

A recess portion is formed in the liquid storing portion case 25. By adhering by thermal welding or the like a thin-film-like material for suppressing permeability to gas to a frame portion of the liquid storing portion case which is a peripheral portion of the recess portion to thereby form a liquid storing chamber 26*a* for storing liquid, the above-mentioned liquid storing portion 26 is formed. The liquid storing chamber 26*a* in the liquid storing portion 26 communicates with the liquid conduit 6 and the branch portion 19 via the communicating portions 23 and 24, respectively. Such a liquid storing portion unit 15 makes it possible to absorb pressure fluctuations accompanying the carriage movement. The internal space of the liquid storing portion 26 is adapted to damp pressure fluctuations of the liquid 5*a* which flows in from the side of the conduit 6 through elastic deformation according to the pressure fluctuations of the liquid, thereby making the liquid 5*a* flow out to the side of the branch portion 19.

The control portion 11 includes a determining portion 11*a* for monitoring the operation of the pressure sensor 22 to determine whether the pressure is most appropriate or not, and a drive portion lib for driving the on-off valve 7. In the determining portion 11*a*, an upper limit and a lower limit of the most appropriate pressure of the liquid 5*a* for being jetted (in this embodiment, the upper limit and the lower limit of the pressure value at the nozzle surface 16 are −0.5 kPa and −1.0 kPa, respectively) are set. The pressure at the nozzle surface 16 measured by the pressure sensor 22 and the set pressure values are compared with each other, and a drive signal is sent to the drive portion 11*b*.

The drive portion lib drives the on-off valve 7 so as to block the conduit 6 or so as to make the conduit communicate. In a blocked state, the flow of the liquid 5*a* in the conduit 6 is interrupted. In a communicating state, the liquid 5*a* in the conduit 6 freely flows in the conduit 6.

Operation of the liquid jet recording apparatus 1 according to this embodiment having the structure described above is now described with reference to FIGS. 1 to 3.

First, an operator supplies the recording medium P to the transfer mechanism 27, and positions the recording medium P below the liquid jet head 13. Then, the liquid 5*a* is jetted from the jetting portion 17 toward the recording medium P, the moving mechanism 14 makes the carriage 12 reciprocate above the recording medium P, and further, the recording medium P is moved in a direction perpendicular to the direction of the reciprocation of the carriage 12 with a certain interval therebetween by the transfer mechanism 27. This makes it possible to jet the liquid 5*a* toward the whole surface of the recording medium P. Here, the conduit 6 is closed by the on-off valve 7. Therefore, as the liquid 5*a* is jetted, the pressure of the liquid 5*a* in the conduit 6 from the on-off valve 7 to the jetting portion 17 is decreased. (conduit blocking process A1 illustrated in FIG. 3)

The pressure of the liquid 5*a* in the liquid jet head 13 at the nozzle surface 16 is measured by the pressure sensor 22 via the pressure transmitting conduit 20 connected to the branch portion 19, and is sent to the determining portion ll*a* in the form of a signal. In this embodiment, the most appropriate value is set to have a certain range (in this embodiment, the pressure value at the nozzle surface 16 is within a range of −0.5 kPa to −1.0 kPa). When the determining portion ll*a* determines that the pressure value at the nozzle surface 16 measured by the pressure sensor 22 is lower than −1.0 kPa, the drive portion ll*b* is activated. The drive portion ll*b* drives the on-off valve 7 to its open position to open the inside of the conduit 6 to communicate the liquid container 5 with the jetting portion 17.

Then, the liquid 5*a* flows through the conduit 6 from the liquid container 5 which is relatively at a higher level toward the jetting portion 17 which is relatively at a lower level. The determining portion 11*a* continually monitors the pressure value at the nozzle surface 16 indicated by the pressure sensor 22. When it is determined that the pressure value at the nozzle surface 16 indicated by the pressure sensor 22 reaches −1.0 kPa, the drive portion 11*b* drives the on-off valve 7 to its closed position to block the inside of the conduit 6. In this way, the pressurization is controlled so that the pressure of the liquid 5*a* falls within the most appropriate range. (pressurization process A2 illustrated in FIG. 3)

When it is determined that, because of pressure fluctuations due to the movement of the carriage 12 or the like, the pressure at the nozzle surface 16 measured by the pressure sensor 22 is lower than −1.0 kPa which is the lower limit value, similar control is exerted. More specifically, the pressurization is controlled so that the pressure value of the liquid 5*a* at the nozzle surface 16 recovers to −1.0 kPa. (pressurization process A3 illustrated in FIG. 3)

On the other hand, when it is determined that the pressure at the nozzle surface 16 measured by the pressure sensor 22 is higher than −0.5 kPa which is the upper limit value, the moving mechanism 14 transfers the carriage 12 to a service station 28*a*. The service station 28*a* is adapted to store, in a waste liquid container 28, the liquid 5*a* which leaks from the nozzle surface 16 of the jetting portion 17. Here, the liquid is jetted from the nozzle surface 16 of the jetting portion 17, and thus, the pressure of the liquid 5*a* from the on-off valve 7 to the jetting portion 17 is decreased.

When the determining portion 11*a* determines that the pressure value at the nozzle surface 16 indicated by the pressure sensor 22 is lower than −0.5 kPa, the jetting of the liquid 5*a* is stopped. After that, the moving mechanism 14 again transfers the carriage to above the recording medium and the jetting of the liquid 5*a* toward the recording medium P starts again. (depressurization process A4 illustrated in FIG. 3)

In the following, charging operation when the liquid 5*a* is charged into the liquid jet head 13 is described. When the liquid jet recording apparatus 1 is used for the first time or when the liquid container 5 is replaced, because a large amount of gas is trapped in the conduit 6, a process of charging the liquid 5*a* into the conduit 6 is carried out. The moving mechanism 14 transfers the carriage 12 to the service station 28*a*. Then, the drive portion ll*b* drives the on-off valve 7 to its open position to make the inside of the conduit 6 communicate with the liquid container 5. This makes the liquid 5*a* flow by gravity from the liquid container 5 to the jetting portion 17.

In this embodiment, the jetting portion 17 and the liquid container 5 are disposed such that the pressure of the liquid 5*a* on the jetting portion 17 is 20 kPa to 60 kPa, and accordingly the liquid 5*a* is appropriately charged into the internal space from the liquid container 5 to the respective nozzles in the jetting portion 17 and leaks from the nozzle surface 16.

Then, the determining portion 11*a* monitors the pressure value indicated by the pressure sensor 22 and determines whether the pressure of the liquid 5*a* in the branch portion 19 is most appropriate or not. When the pressure value indicated by the pressure sensor 22 is outside the most appropriate range, based on the result of comparison by the determining portion 11*a* between the pressure value indicated by the pressure sensor 22 and the most appropriate range, the liquid 5*a* is discharged from the jetting portion 17, or the drive portion 11*b* drives the on-off valve 7 to open and the liquid 5*a* is supplied from the liquid container 5 to the jetting portion 17 side. When it is determined that the pressure value indicated by the pressure sensor 22 is within the most appropriate range, discharge of the liquid 5*a* by the jetting portion 17 is stopped, or the on-off valve 7 is driven to block the inside of the conduit 6, thereby interrupting the flow of the liquid 5*a*. In this way, the pressure of the liquid 5*a* is held within the most appropriate range. After that, a liquid jet recording process can be started.

As described above, in the liquid jet recording apparatus 1 of this embodiment, the pressure of the liquid 5*a* which is damped by the liquid storing portion unit 15 is measured by the pressure sensor 22 which is connected via the pressure transmitting conduit 20 disposed between the liquid storing portion unit 15 and the jetting portion 17, and the result is sent to the control portion 11. When the pressure is insufficient or excessive, the control portion 11 operates the on-off valve 7 to be driven according to the value measured by the pressure sensor 22 and the liquid 5*a* in the conduit 6 is adapted to be sent so that the pressure falls within the most appropriate range.

With such a structure, the liquid jet recording apparatus according to this embodiment can, even when the flow path is long and pressure loss in the flow path increases, measure the pressure value of the liquid 5*a* at the nozzle surface 16, and thus, the liquid 5*a* can be supplied with the pressure which is held appropriate.

Further, because the liquid jet recording apparatus includes the liquid storing portion unit 15, pressure fluctuations of the liquid 5*a* accompanying the movement of the carriage 12 can be suppressed. Further, as described above, by measuring the pressure of the liquid 5*a* existing between the liquid storing portion unit 15 and the nozzle surface 16, measurement can be made with regard to the liquid of which the pressure fluctuations are damped by the liquid storing portion unit 15. This makes it possible to prepare an appropriate printing environment, because, even when the influence of pressure loss due to increased flow path or the influence of pressure fluctuations due to the movement of the carriage remains, the pressure of the liquid 5*a* at the nozzle surface 16 can be measured.

Further, in this embodiment, the on-off valve 7 is fixed to the frame 4. This can improve the drive efficiency of the apparatus and the liquid can be discharged at low energy. More specifically, in this embodiment, because the on-off valve 7 is fixed to the frame 4, that is, on the side of the apparatus, the carriage 12 which scans above the recording medium P can be formed so as to be lightweight. Generally, a solenoid valve in which a valve element is electrically controlled or the like is thought to be too heavy to be mounted on a scanning carriage. Therefore, in this embodiment, the on-off valve 7 is disposed on the frame 4 and the carriage 12 can be operated with agility.

Further, the method of controlling the pressure of the liquid 5*a* with the structure of this embodiment is carried out by blocking the inside of the conduit 6 or making the inside of the conduit 6 communicate by the on-off valve 7. Therefore, compared with a conventional method of controlling the pressure of the liquid 5*a* by introducing gas into the liquid container 5, deterioration of the liquid 5*a* due to exposure of the liquid 5*a* to the gas is suppressed, and thus the liquid can be jetted satisfactorily.

Further, the material of the pressure transmitting conduit 20 of this embodiment suppresses permeability to gas, and hence entry of outside air via the wall of the conduit into the liquid 5*a* which flows from the branch portion 19 into the pressure transmitting conduit 20 is suppressed. This suppresses increased viscosity, hardening, or alteration (hereinafter collectively referred to as deterioration) of the liquid 5*a*, and attachment of the deteriorated liquid 5*a* to a pressure detecting portion 21 of the pressure sensor 22 and blocking of a part or all of the flow path of the liquid 5*a* to the jetting portion 17 by the deteriorated liquid 5*a* which result in lowered precision of jetting the liquid are suppressed.

Further, the pressure transmitting conduit 20 is detachably attachable to the branch portion 19. This makes it possible to, when the flow path of the liquid 5*a* from the liquid container 5 to the jetting portion 17 is cleaned, clean separately the pressure transmitting conduit 20 which is difficult to clean by moving a cleaner in and out.

Further, the pressure transmitting conduit 20 is connected to the branch portion 19*a* formed in a part of the flow path of the liquid 5*a* on the side of the jetting portion 17 from the liquid storing portion unit 15. The liquid storing portion unit 15 absorbs pressure fluctuations in the conduit 6 on the side of the liquid container 5 with the liquid storing portion 26 to make smaller the range of the pressure fluctuations. Therefore, the pressure having the fluctuation range which is made smaller is transmitted to the branch portion 19 and is measured by the pressure sensor 22 via the pressure transmitting conduit 20. Further, because the length of the flow path of the liquid 5*a* from the branch portion 19 to the jetting portion 17 is short, the difference between the pressure measured by the pressure sensor 22 and the pressure of the liquid 5*a* supplied to the nozzle surface 16 can be made smaller.

Further, in this embodiment, the most appropriate value is set to have a certain width (the pressure value at the nozzle surface 16 is within the range of −0.5 kPa to −1.0 kPa in this embodiment). If a single value is set as the most appropriate value of the pressure, when, during a very small time lag from when the most appropriate value is indicated by the pressure sensor 22 to when the control portion 11 monitors the value and the on-off valve 7 is driven to block the conduit, the liquid 5*a* is pressurized toward the jetting portion 17 and the pressure thereof deviates from the most appropriate value in the opposite direction, frequent control may be carried out in order to decrease such minute pressure fluctuations. With regard to the depressurization process A4 in this embodiment in which, when the pressure of the liquid 5*a* in the branch portion 19 exceeds −0.5 kPa which is the upper limit pressure value, the liquid 5*a* is discharged to exert depressurization control, according to the present invention, the most appropriate value has a range and a mechanism for blocking the conduit 6 with the on-off valve 7 in the case of minute pressure fluctuations within the range of the most appropriate value is adopted, and hence the frequency of the depressurization process A4 is suppressed, which suppresses unnecessary consumption of the liquid 5*a*.

In the following, as a modification of the open/close control of the on-off valve 7, correction control for correcting the difference between the pressure value measured by the pressure detecting portion 21 of the pressure sensor 22 and the pressure at the nozzle surface 16 due to the level difference between the branch portion 19 and the nozzle surface 16 is described in detail.

There is a level difference to some extent between the branch portion 19 and the nozzle surface 16, and hence the pressure values at the two may differ from each other. In order to solve this problem, in this modification, the control portion 11 exerts correction control (correction control process A5) for correcting the pressure value measured by the pressure detecting portion 21 so as to indicate the pressure value at the nozzle surface 16.

The correction control (correction control process A5) uses a correction table (not shown) in which the correlation between the pressure measured by the pressure sensor 22 and the pressure at the nozzle surface 16 is described. The correction table is provided in the determining portion 11*a* of the control portion 11. The determining portion 11*a* refers to the correction table and converts the pressure value measured by the pressure sensor 22 to a pressure value at the nozzle surface 16, to thereby determine whether the pressure value at the nozzle surface 16 falls within the most appropriate range or not.

The drive portion lib is adapted to drive the on-off valve 7 to be opened/closed by sending to the on-off valve 7 a drive signal according to determination by the determining portion 11*a* based on the pressure value after conversion.

It is to be noted that, in this modification, a corrected value may be calculated in advance according to the structure of the liquid jet head 13 and the corrected value may be used from the beginning by the determining portion 11*a*.

(Second Embodiment)

Next, a liquid jet recording apparatus according to a second embodiment of the present invention is now described with reference to FIG. 4. It is to be noted that, in the embodiment described in the following, common numerals and symbols are used to designate identical members in the structure of the first embodiment described above and description thereof is omitted.

Figure 4:
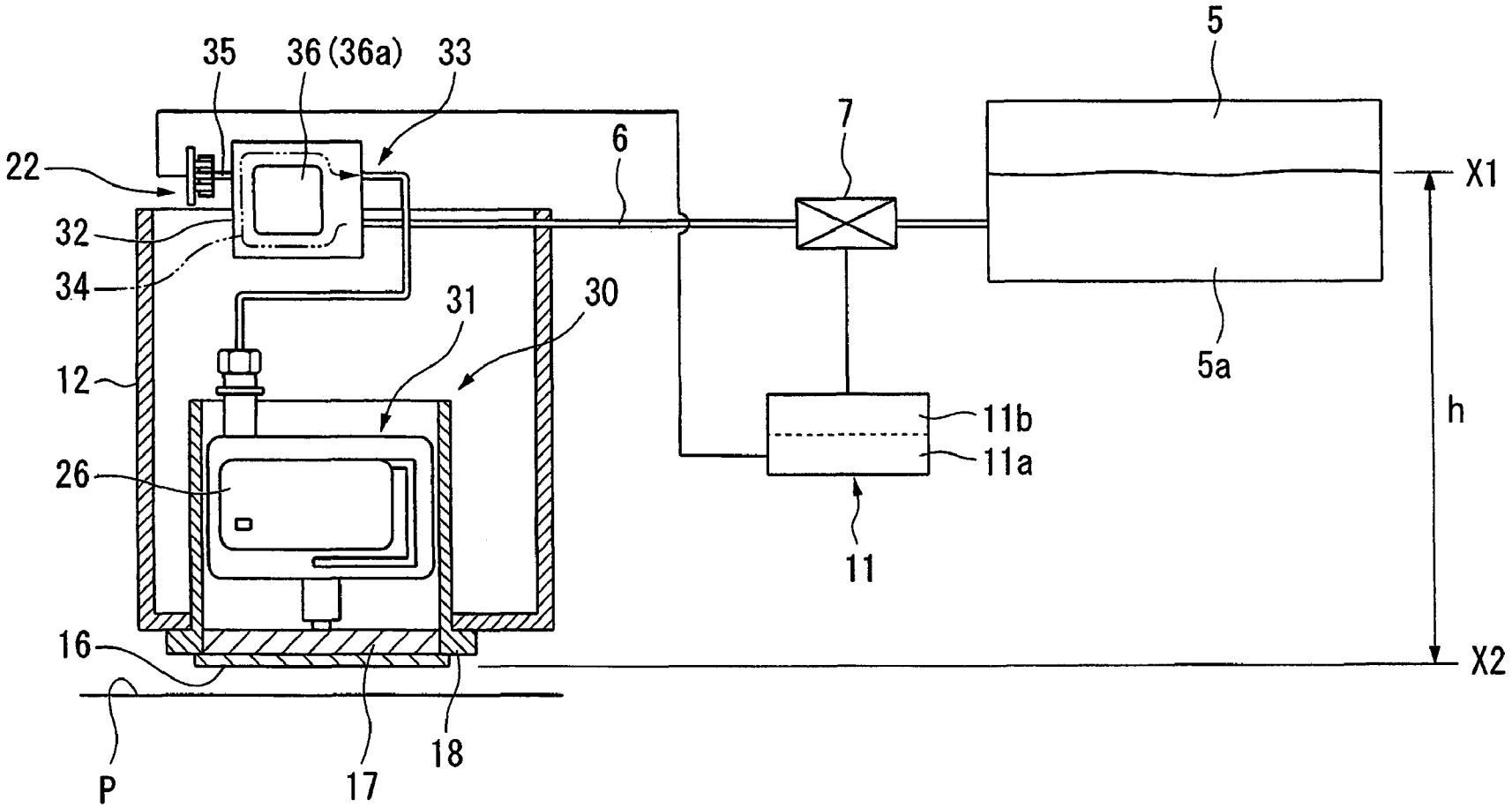
FIG. 4 is an explanatory view of a structure of a flow path of liquid from a liquid container to a jetting portion according to a second embodiment of the present invention.

FIG. 4 is an explanatory view for describing a structure of a flow path of liquid in the liquid jet recording apparatus according to the second embodiment of the present invention.

A liquid storing portion unit 31 of a liquid jet head 30 of this embodiment is a conventional liquid storing portion without a branch tube. A part of the carriage 12 is a second support portion 32 to which a liquid storing portion unit 33 including the pressure sensor 22 is fixed. This embodiment is different from the first embodiment in that a branch tube 35 is formed at a liquid storing portion case 34 and the pressure sensor 22 is connected thereto. Because the branch tube 35 is open on the side of the jetting portion 17 from a liquid storing portion 36 of the liquid storing portion unit 33, pressure damped by the liquid storing portion unit 33 is transmitted to the pressure sensor 22.

Further, the liquid storing portion unit 33 is in a part of the conduit 6 between the on-off valve 7 and the liquid storing portion unit 31. Here, the length of the flow path of the liquid 5*a* from the liquid storing portion unit 33 to the jetting portion 17 is adjusted to fall within a range of 50 mm to 600 mm, which are the most appropriate values for the liquid supply flow path in this embodiment.

In the second embodiment, with regard to the liquid jet head 30 which cannot include the pressure sensor 22 in the flow path of the liquid 5*a* between the liquid storing portion unit 31 and the jetting portion 17, by additionally disposing the liquid storing portion unit 33 in the conduit 6 between the on-off valve 7 and the jetting portion 17 on the side of the carriage 12, and further, by disposing the pressure sensor 22 in the flow path of the liquid 5*a* between the liquid storing portion unit 33 and the jetting portion 17, similarly to the case of the first embodiment, it becomes possible to measure the pressure of the liquid 5*a* after pressure fluctuations are damped by the liquid storing portion unit 33. In the second embodiment, similarly to the case of the first embodiment, the control portion 11 monitors the pressure value measured by the pressure sensor 22. When the value is outside the range between the lower limit pressure value and the upper limit pressure value, by opening/closing the on-off valve 7 or by jetting the liquid 5*a* from the jetting portion 17, the liquid 5*a* is pressurized or depressurized to adjust the pressure of the liquid 5*a* supplied to the liquid jet head 30.

Further, because the pressure sensor 22 makes the measurement at the liquid storing portion unit 33, compared with the case of the first embodiment, the pressure of the liquid 5*a* is measured farther from the nozzle surface 16. In this case, the pressure value of the liquid 5*a* at the nozzle surface 16 may be different from the measured value of the liquid 5*a* at the liquid storing portion unit 33. In such a case, similarly to the case of the first embodiment, by correcting the pressure value measured by the pressure sensor 22, the pressure of the liquid 5*a* at the nozzle surface 16 can also be held within the most appropriate range.

Further, the second embodiment is different from the first embodiment in that the pressure value at the liquid storing portion 36 of the liquid storing portion unit 33 is measured. The liquid 5*a* is stored in the liquid storing portion 36. When the measurement is made at the liquid storing portion 36, compared with a case in which the measurement is made in the flow path or in the conduit, the amount of displacement of the liquid 5*a* and the fluctuations of the pressure value become smaller. More specifically, in the second embodiment, by adopting such a structure, because the pressure sensor 22 measures the pressure value at a place in which the liquid 5*a* is stored, fluctuations of the measured pressure value and the fear of noise in the pressure value can be reduced. Therefore, in the second embodiment, the pressure value of the liquid 5*a* can be measured with stability.

Embodiments according to the present invention are described in detail with reference to the attached drawings in the above. However, specific structures are not limited thereto and various modifications including design changes can be made without departing from the gist of the present invention.

For example, in the embodiments according to the present invention, the target values of the pressure at the nozzle surface 16 controlled by the control portion 11, and measured by the pressure sensor 22 are most appropriate when the values fall within a range of −0.5 kPa and −1.0 kPa, but the precision of the jetting of the liquid 5*a* may also be satisfied when the target values are set so as to fall within a range of +0.5 kPa and −2.0 kPa. In this case, by extending the range of the target values, the frequency of driving the on-off valve 7 for adjusting the pressure can be decreased.

Further, though, in the embodiments of the present invention, the liquid container 5 is adopted as the container of the liquid, the present invention is not limited thereto. For example, a liquid supply mechanism including a main tank for containing a relatively large amount of liquid and an auxiliary tank connected via a tubular member to the main tank for containing part of the liquid contained in the main tank may be adopted.

Further, although, in the first embodiment of the present invention, the pressure sensor 22 measures the pressure value from the branch portion 19 via the pressure transmitting conduit 20, a pressure measuring chamber in which the liquid 5*a* is stored may be provided adjacent to the pressure detecting portion 21 of the pressure sensor 22. By adopting such a structure, even in the first embodiment, the stability of the measurement of the pressure value of the liquid 5*a* can be enhanced.

Further, although, in the first embodiment of the present invention, a structure in which the pressure transmitting conduit 20 is made of a tubular flexible member which suppresses entry of gas is adopted, the present invention is not limited thereto. According to the properties of the liquid 5*a* to be charged into the pressure transmitting conduit and the like, a member made of a different material may be used. For example, if a metallic tubular member made of stainless steel or the like is adopted as the pressure transmitting conduit, the durability of the pressure transmitting conduit is increased, and entry of gas into the pressure transmitting conduit through cracks due to aging and the like is suppressed. If a structure is adopted in which the pressure transmitting conduit is covered with a light-blocking coating or the pressure transmitting conduit is formed of a light-blocking material, passing of light through the pressure transmitting conduit is suppressed, and thus, hardening or alteration due to ultraviolet radiation or visible radiation is suppressed.

Further, although, in the second embodiment of the present invention, a structure in which the pressure sensor 22 is fixed to the liquid storing portion unit 33 is adopted, it is merely required that the pressure sensor 22 be located such that the pressure of the liquid 5*a* after pressure fluctuations are damped by the liquid storing portion unit 33 may be measured. For example, the branch tube 35 may be formed in a part of the liquid storing portion unit 33 at which the liquid 5*a* flows out and the pressure sensor 22 may be connected to one end of the branch tube 35. Alternatively, another branch tube may be provided in part of the flow path of the liquid 5*a* from the liquid storing portion unit 33 to the jetting portion 17 and the pressure sensor 22 may be connected to one end of the branch tube.

Further, in the second embodiment of the present invention, a structure in which the liquid storing portion unit 31 is mounted in advance on the liquid jet head 30 is adopted. However, the present invention is not limited thereto, and it is also possible to dispose the liquid storing portion unit 33 and the pressure sensor 22 according to the present invention at the second support portion 32 with respect to a liquid jet head without the liquid storing portion unit 31 mounted thereon. In this case, pressure fluctuations of the liquid 5*a* may also be damped by the liquid storing portion unit 33 and the pressure of the liquid 5*a* after pressure fluctuations are damped may also be measured by the pressure sensor 22.

What is claimed is:

1. A liquid jet recording apparatus, comprising:

a liquid container for containing liquid;

a jetting portion which is disposed lower than a surface of the liquid contained in the liquid container and which includes a plurality of nozzles for jetting the liquid;

a conduit communicating the jetting portion with the liquid container;

an on-off valve disposed in the conduit and fixed to a frame, the on-off valve permitting the liquid to flow through the conduit when the on-off valve is opened and blocking the flow of the liquid through the conduit when the on-off valve is closed;

a liquid storing portion, disposed in the conduit between the on-off valve and the jetting portion, for damping pressure fluctuations of the liquid;

pressure measuring means for measuring the pressure of the liquid which flows through the conduit, the pressure measuring means being disposed in the conduit between the liquid storing portion and the jetting portion; and a control portion for controlling the on-off valve to be opened and closed based on a pressure value measured by the pressure measuring means, the control portion being electrically connected to the pressure measuring means and the on-off valve.

2. A liquid jet recording apparatus according to claim 1, wherein the pressure measuring means is directly disposed in the conduit which connects the liquid storing portion and the jetting portion.

3. A liquid jet recording apparatus according to claim 1, wherein the pressure measuring means is connected to a pressure transmitting conduit which is branched from the conduit communicating the liquid storing portion and the jetting portion.

4. A liquid jet recording apparatus according to claim 3, wherein the pressure transmitting conduit comprises a flexible tube which is impervious to gas.

5. A liquid jet recording apparatus according to claim 3, wherein the pressure transmitting conduit is made of a metallic material.

6. A liquid jet recording apparatus according to claim 3, wherein the pressure transmitting conduit is made of a flexible member which suppresses permeability to light having a specific wavelength.

7. A liquid jet recording apparatus according to claim 3, wherein the pressure transmitting conduit is detachable from the conduit.

8. A liquid jet recording apparatus according to claim 1, further comprising a carriage which supports the jetting portion and which is capable of reciprocating above a recording medium toward which the liquid is jetted, the jetting portion being supported at a predetermined distance from the recording medium, wherein the liquid storing portion is fixed to and supported by the carriage.

9. A liquid jet recording apparatus according to claim 8, wherein the portion of the conduit that extends between the pressure measuring means and the jetting portion has a length in a range of 50 mm to 600 mm.

10. A liquid jet recording apparatus according to claim 8, wherein the pressure measuring means is disposed +10 mm to +300 mm above a level of the nozzles of the jetting portion.

11. A liquid jet recording apparatus according to claim 8, wherein the liquid storing portion includes a liquid storing chamber formed of a flexible thin-film-like member and the flexible thin-film-like member suppresses entry or leakage of gas from outside of the liquid storing portion via the flexible thin-film-like member.

12. A liquid jet recording apparatus according to claim 1, wherein the pressure value of the liquid supplied to the jetting portion is in a range of 20 kPa to 60 kPa.

13. A liquid jet recording method using the liquid jet recording apparatus according to claim 1, comprising:

monitoring a pressure value indicated by the pressure measuring means and measuring a pressure of the liquid;

determining whether the pressure of the liquid is between an upper limit pressure and a lower limit pressure which are set in advance; and blocking the flow of the liquid through the conduit by closing the on-off valve when the pressure of the liquid is between the upper limit pressure and the lower limit pressure, permitting the flow of the liquid through the conduit by opening the on-off valve when the pressure of the liquid is lower than the lower limit pressure, and discharging the liquid jetted from the jetting portion when the pressure of the liquid is higher than the upper limit pressure.

14. A liquid jet recording method according to claim 13, further comprising exerting correction control by the control portion with regard to the difference between the pressure value in the nozzles and the pressure value measured by the pressure measuring means.

15. A liquid jet recording method according to claim 13, wherein the upper limit pressure value and the lower limit pressure value are set with regard to the pressure value of the liquid in the nozzle.

16. A liquid jet recording method according to claim 15, wherein the upper limit pressure value is +0.5 kPa and the lower limit pressure value is −2.0 kPa.

17. A liquid jet recording method according to claim 15, wherein the upper limit pressure value is −0.5 kPa and the lower limit pressure value is −1.0 kPa.

* * * * *